US012723296B2

(12) United States Patent
Hirakawa et al.

(10) Patent No.: US 12,723,296 B2
(45) **Date of Patent: *Sep. 1, 2026**

(54) AUSTENITE STAINLESS STEEL MATERIAL, METHOD FOR PRODUCING SAME, AND PLATE SPRING

(71) Applicant: NIPPON STEEL STAINLESS STEEL CORPORATION, Tokyo (JP)

(72) Inventors: Naoki Hirakawa, Tokyo (JP); Masaya Tanaka, Tokyo (JP); Eiichiro Ishimaru, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 697 days.

This patent is subject to a terminal disclaimer.

(21) Appl. No.: 17/924,573

(22) PCT Filed: May 11, 2021

(86) PCT No.: PCT/JP2021/017915
§ 371 (c)(1),
(2) Date: Nov. 10, 2022

(87) PCT Pub. No.: WO2021/230244
PCT Pub. Date: Nov. 18, 2021

(65) Prior Publication Data

US 2023/0250522 A1 Aug. 10, 2023

(30) Foreign Application Priority Data

May 13, 2020 (JP) ..... 2020-084764

(51) Int. Cl.

| | |
|---|---|
| ***C22C 38/02*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 9/46*** | (2006.01) |
| ***C22C 38/00*** | (2006.01) |

(Continued)

(52) U.S. Cl.
CPC ..... *C22C 38/44* (2013.01); *C21D 6/004* (2013.01); *C21D 6/005* (2013.01); *C21D 8/02* (2013.01); *C21D 8/0236* (2013.01); *C21D 8/0247* (2013.01); *C21D 9/46* (2013.01); *C22C 38/001* (2013.01); *C22C 38/02* (2013.01); *C22C 38/04* (2013.01); *C22C 38/42* (2013.01); *C21D 8/0226* (2013.01); *C21D 2211/001* (2013.01); *C21D 2211/008* (2013.01); *C22C 38/00* (2013.01); *C22C 38/002* (2013.01); *C22C 38/004* (2013.01); *C22C 38/008* (2013.01); *C22C 38/06* (2013.01); *C22C 38/34* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C22C 38/60* (2013.01)

(58) Field of Classification Search
CPC ..... C22C 38/44
See application file for complete search history.

(56) References Cited

U.S. PATENT DOCUMENTS

2015/0376729 A1* 12/2015 Matsubayashi ..... C22C 38/54 148/624
2018/0037970 A1 2/2018 Matsumura et al.
(Continued)

FOREIGN PATENT DOCUMENTS

CN 108754333 A 11/2018
JP 5-279802 A 10/1993
(Continued)

OTHER PUBLICATIONS

English machine translation of JP 2002-146483 A of Takano (Year: 2002).*

*Primary Examiner* — Jophy S. Koshy
(74) *Attorney, Agent, or Firm* — Birch, Stewart, Kolasch & Birch, LLP

(57) ABSTRACT

Provided is an austenitic stainless steel material, wherein the austenitic stainless steel material comprises, on a mass basis, 0.200% or less of C, 1.00 to 3.50% of Si, 5.00% or less of Mn, 4.00 to 10.00% of Ni, 12.00 to 18.00% of Cr, 3.500% or less of Cu, 1.00 to 5.00% of Mo, and 0.200% or less of N, a total amount of C and N is 0.100% or more, and the balance is Fe and impurities;

wherein the austenitic stainless steel material has a composition having a value of $Md_{30}$ of −40.0 to 0° C., wherein the value of $Md_{30}$ is represented by the following equation (1):

$$Md_{30}=551-462(C+N)-9.2Si-8.1Mn-29(Ni+Cu)-13.7Cr-18.5Mo \quad (1)$$

in which the symbols of the elements each represents a content (% by mass) of each element;

wherein the austenitic stainless steel material has a metallographic structure comprising 25 to 35% by volume of strain-induced martensite phase; and wherein the austenitic stainless steel material has a tensile strength (TS) of 1450 MPa or more, an elongation at break (EL) of 12.0% or more, TS×EL of 24000 or more, and a stress relaxation percentage of 1.20% or less, wherein the stress relaxation percentage is represented by the following equation (2):

$$\text{stress relaxation percentage}=(\sigma1-\sigma2)/\sigma1 \quad (2)$$

in which σ1 is a stress less than 0.2% yield strength, and σ2 is a stress on 200 seconds after applying the stress of σ1.

13 Claims, No Drawings

(51) Int. Cl.

| | |
|---|---|
| ***C22C 38/04*** | (2006.01) |
| ***C22C 38/42*** | (2006.01) |
| ***C22C 38/44*** | (2006.01) |
| *C22C 38/06* | (2006.01) |
| *C22C 38/34* | (2006.01) |
| *C22C 38/46* | (2006.01) |
| *C22C 38/48* | (2006.01) |
| *C22C 38/50* | (2006.01) |
| *C22C 38/52* | (2006.01) |
| *C22C 38/54* | (2006.01) |
| *C22C 38/58* | (2006.01) |
| *C22C 38/60* | (2006.01) |

(56) References Cited

U.S. PATENT DOCUMENTS

| | | | | |
|---|---|---|---|---|
| 2023/0250522 | A1* | 8/2023 | Hirakawa | C22C 38/58<br>420/45 |
| 2023/0399728 | A1* | 12/2023 | Tanaka | C21D 8/0226 |

FOREIGN PATENT DOCUMENTS

| | | | | |
|---|---|---|---|---|
| JP | 2002146483 | A | * | 5/2002 |
| JP | 2009-221553 | A | | 10/2009 |
| JP | 2011-47008 | A | | 3/2011 |
| JP | 2015-86405 | A | | 5/2015 |
| JP | 6229180 | B1 | | 11/2017 |
| JP | WO2019/240127 | A1 | | 12/2019 |

* cited by examiner

AUSTENITE STAINLESS STEEL MATERIAL, METHOD FOR PRODUCING SAME, AND PLATE SPRING

FIELD OF THE INVENTION

The present invention relates to an austenite stainless steel material, a method for producing the same, and a plate spring.

BACKGROUND OF THE INVENTION

As communication devices such as smartphones and precision devices such as personal computers become smaller and more powerful, the structural and functional parts used in these devices are becoming thinner and lighter. Therefore, the materials used for these parts are required to have excellent workability (ductility) and high strength. In particular, parts such as plate springs, which are exposed to repeated stress, are required to have properties that can withstand repeated stress (settling resistance). Here, the "settling resistance" refers to a property to withstand "settling" which means that the material does not completely return to its original shape due to minute deformation after repeated use under elastic stress.

Traditionally, metastable austenitic stainless steels such as SUS 301 have been used as materials for structural and functional parts. The strength of the metastable austenitic stainless steel can be increased by temper rolling, but its ductility cannot be sufficient.

As the austenite stainless steel material having both high strength and high ductility, for example, Patent Literature 1 proposes a metastable austenitic stainless steel, which consists of one or more selected from the group consisting of 0.05 to 0.15% of C; 0.05 to 1% of SI; 2% or less of Mn; 16 to 18% of Cr; 4 to 11% of Ni; 2.5% to 3.5% of Mo; 0.1% to 3.5% of Al; 0.1% to 3% of Ti, in % by mass, the balance being Fe and inevitable impurities, and which has a certain two phase structure composed of a strain-induced martensite phase (α' phase) and an austenite phase (γphase), and which has a 0.2% yield strength (YS) of 1400 $N/mm^2$ to 1900 $N/mm^2$, and YS×EL of 21000 to 48,000.

On the other hand, as a material used for spring parts, Patent Literature 2 proposes a stainless steel having excellent spring properties and excellent fatigue properties of processed portion, wherein it consists of 0.08% or less of C; 3.0% or less of Si; 4.0% or less of Mn; 4.0 to 10.0% of Ni; 13.0 to 20.0% of Cr; 0.06 to 0.30% of N, and 0.007% or less of O, in % by weight, and amounts of C, Si, Mn, Ni, Cr and N are controlled so that an M value according the equation: M=330−(480×C %)−(2×Si %)−(10×Mn %)−(14×Ni %)−(5.7×Cr %)−(320×N %) is 40 or more, the balance being Fe and impurities inevitably contaminated.

Also, Patent Literature 3 proposes an austenite stainless steel for springs, wherein it consists of, in % by mass, C≤0.15%, Si≤4.0%, 4.0%≤Mn≤10.0%, P≤0.10%, S≤0.010%, 2.0%≤Ni≤6.0%, 16.0%≤Cr≤18.0%, 0.05%≤N≤0.20%, the balance being Fe and inevitable impurities, and wherein an $Md_{30}Mn$ value according to the equation: $Md_{30}Mn$=551−62(% C+% N)−29(% Ni+% Cu)+4.8% Si−19.1% Mn−13.7% Cr−18.5% Mo satisfies $-35 \leq Md_{30}Mn \leq 0$, and a tensile strength of 1320 MPA or more is imparted by cold rolling.

PRIOR ART

Patent Literatures

[Patent Literature 1] Japanese Patent No. 6229180 B

[Patent Literature 2] Japanese Patent Application Publication No. H05-279802A

[Patent Literature 3] Japanese Patent Application Publication No. 2011-47008 A

SUMMARY OF THE INVENTION

Problem to be Solved by the Invention

Although the austenitic stainless steel material described in Patent Literature 1 has both high strength and high ductility, the patent literature does not consider the settling resistance required for functional parts such as plate springs.

Although Patent Literature 2 mentions that the described stainless steel has good moldability, the stainless steel does not satisfy the workability (ductility) required for various parts used for communication devices and precision devices. In fact, the elongation of the stainless steel described in Examples of Patent Literature 2 is 4.0 to 7.3%, which cannot be sufficient ductility.

The austenitic stainless steel described in Patent Literature 3 is subjected a temper-roll finishing, which has not been subjected to any heat treatment at a low temperature. Therefore, the austenitic stainless steel cannot have sufficient settling resistance.

The present invention has been made to solve the above problems. An object of the present invention is to provide an austenitic stainless steel material having high strength, high ductility, and improved settling resistance, and to provide a method for producing the same.

Another object of the present invention is to provide a plate spring having high strength, excellent dimensional accuracy, and a long life.

Means for Solving the Problem

The present inventors have found that the above problems can be solved by controlling the composition, metallographic structure, tensile strength (TS), elongation at break (EL), TS×EL and stress relaxation percentage of the austenitic stainless steel material, and have completed the present invention.

Thus, the present invention relates to an austenitic stainless steel material, wherein the austenitic stainless steel material comprises, on a mass basis, 0.200% or less of C, 1.00 to 3.50% of Si, 5.00% or less of Mn, 4.00 to 10.00% of Ni, 12.00 to 18.00% of Cr, 3.500% or less of Cu, 1.00 to 5.00% of Mo, and 0.200% or less of N, a total amount of C and N is 0.100% or more, and the balance is Fe and impurities;

wherein the austenitic stainless steel material has a composition having a value of $Md_{30}$ of −40.0 to 0° C., wherein the value of $Md_{30}$ is represented by the following equation (1):

$$Md_{30}=551-462(C+N)-9.2Si-8.1Mn-29(Ni+Cu)-13.7Cr-18.5Mo \quad (1)$$

in which the symbols of the elements each represents a content (% by mass) of each element;

wherein the austenitic stainless steel material has a metallographic structure comprising 25 to 35% by volume of strain-induced martensite phase; and wherein the austenitic stainless steel material has a tensile strength (TS) of 1450 MPa or more, an elongation at break (EL) of 12.0% or more, TS×EL of 24000 or more, and a stress relaxation percentage of 1.20% or less, wherein the stress relaxation percentage is represented by the following equation (2):

$$\text{stress relaxation percentage}=(\sigma 1-\theta 2)/\sigma 1 \quad (2)$$

in which σ1 is a stress less than 0.2% yield strength, and σ2 is a stress on 200 seconds after applying the stress of σ1.

Also, the present invention relates to a method for producing an austenitic stainless steel material, the method comprising:

subjecting a rolled material to a solution heat treatment and then cold-rolling the rolled material at a rolling ratio sufficient to generate 25 to 35% by volume of strain-induced martensite phase, wherein the rolled material comprises, on a mass basis, 0.200% or less of C, 1.00 to 3.50% of Si, 5.00% or less of Mn, 4.00 to 10.00% of Ni, 12.00 to 18.00% of Cr, 3.500% or less of Cu, 1.00 to 5.00% of Mo, and 0.200% or less of N, a total amount of C and N is 0.100% or more, and the balance is Fe and impurities, and wherein the rolled material has a composition having a value of $Md_{30}$ of −40.0 to 0° C., the value of $Md_{30}$ being represented by the following equation (1):

$$Md_{30}=551-462(C+N)-9.2Si-8.1Mn-29(Ni+Cu)-13.7Cr-18.5Mo \quad (1)$$

in which the symbols of the elements each represents a content (% by mass) of each element; and then subjecting the rolled material to a heat treatment at a temperature of 100 to 200° C. such that a value of P satisfies 7000 to 9400, wherein the value of P is represented by the following equation (3):

$$P=T(\log t+20) \quad (3)$$

in which T is temperature (K) and t is time (h).

Further, the present invention relates to a plate spring comprising the austenitic stainless steel material as described above.

Effects of the Invention

According to the present invention, it is possible to provide an austenitic stainless steel material having high strength, high ductility, and improved settling resistance, and to provide a method for producing the same.

Also, according to the present invention, it is possible to provide a plate spring having high strength, excellent dimensional accuracy, and a long life.

DETAILED DESCRIPTION OF THE INVENTION

Hereinafter, embodiments of the present invention will be specifically described. It is to understand that the present invention is not limited to the following embodiments, and those which have appropriately added changes, improvements and the like to the following embodiments based on knowledge of a person skilled in the art without departing from the spirit of the present invention fall within the scope of the present invention.

It should be noted that, as used herein, the expression "%" in relation to any component means "% by mass", unless otherwise specified.

An austenitic stainless steel material according an embodiment of the present invention comprises 0.200% or less of C, 1.00 to 3.50% of Si, 5.00% or less of Mn, 4.00 to 10.00% of Ni, 12.00 to 18.00% of Cr, 3.500% or less of Cu, 1.00 to 5.00% of Mo, and 0.200% or less of N, a total amount of C and N of 0.100% or more, and the balance being Fe and impurities.

Here, the term "stainless steel material" as used herein means a material formed of stainless steel, and a shape of the material is not particularly limited. Examples of the shape include a plate shape (including a strip shape), a rod shape, and a tubular shape. Further, the material may be various shaped steels having cross-sectional shapes such as T-shape and I-shape. Further, the "impurities" means components which are contaminated due to various factors such as raw materials such as ore and scrap and production steps when the austenitic stainless steel material is industrially produced, and which are acceptable in a range that does not adversely affect the present invention. For example, those impurities also include inevitable impurities such as P and S, which are difficult to be removed.

Furthermore, the austenitic stainless steel material according to an embodiment of the present invention can further contain one or more selected from: 0.100% or less of Al, 0.010% or less of O, 0.0001 to 0.500% of V, and 0.0001 to 0.015% of B.

Moreover, the austenitic stainless steel material according to an embodiment of the present invention can further contain one or more selected from: 0.010 to 0.500% of Ti, 0.010 to 0.500% of Co, 0.010 to 0.100% of Zr, 0.010 to 0.100% of Nb, 0.0005 to 0.0030% of Mg, 0.0003 to 0.0030% of Ca, 0.010 to 0.200% of Y, 0.001 to 0.100% of Ln, 0.001 to 0.500% of Sn, 0.001 to 0.500% of Sb, 0.010 to 0.100% of Pb, and 0.010 to 0.500% of W.

Each component will be described below in detail.

<0.200% or Less of C>

The C is an intrusion-type element and contributes to high strength by work hardening and heat treatment. Further, the C is an element that stabilizes the austenite phase and is effective for maintaining non-magnetism. However, if the C content is too high, it becomes hard and causes a decrease in cold workability. Therefore, the upper limit of the C content is set to 0.200%, and preferably 0.100%, and more preferably 0.090%. On the other hand, the lower limit of the C content is not particularly limited, but it may preferably be set to 0.010%, and more preferably 0.015%, and even more preferably 0.020%, in terms of refining costs.

<1.00 to 3.50% of Si>

The Si is an element used as a deoxidizing agent for stainless steel in the steelmaking process. Further, the Si has a function of improving aging hardening properties in a heat treatment after cold rolling. From the viewpoint of sufficiently obtaining these effects, the lower limit of the Si content is set to 1.00%, and preferably 1.20%, and more preferably 1.50%. On the other hand, the Si has a higher solid solution strengthening function and has an action of decreasing stacking fault energy to improve work hardening. Therefore, an excessively high Si content will be a factor of decreasing cold workability. Therefore, the upper limit of the Si content is set to 3.50%, and preferably 3.20%, and more preferably 3.00%.

<5.00% or Less of Mn>

The Mn is an element that forms oxide-based inclusions as MnO. Further, the Mn has a lower solid solution strengthening function and is an austenite-forming element, and has a function of suppressing strain-induced martensitic transformation. Therefore, the upper limit of the Mn content is set to 5.00%, and preferably 4.00%, and more preferably 3.00%. On the other hand, the lower limit of the Mn content is not particularly limited, but it may preferably be set to 0.01%, and more preferably 0.05%, and even more preferably 0.10%.

<4.00 to 10.00% of Ni>

The Ni is an element contained to obtain an austenite phase at an elevated temperature and room temperature. It is necessary to contain Ni in order to form a metastable austenite phase at room temperature and to allow the martensite phase to be induced during cold rolling. If the Ni content is too low, o ferrite phases are formed at an elevated temperature, and the martensite phases are also formed in the cooling process to the room temperature, which will not allow any austenite monophase to be present. Therefore, the lower limit of the Ni content is set to 4.00%, and preferably 4.50%, and more preferably 5.00%. On the other hand, if the Ni content is too high, the martensite phase is difficult to be induced during the cold rolling. Therefore, the upper limit of the Ni content is set to 10.00%, and preferably 9.50%, and more preferably 9.00%.

<12.00 to 18.00% of Cr>

The Cr is an element that improves corrosion resistance. From the viewpoint of ensuring corrosion resistance suitable for structural parts and functional parts (particularly plate springs), the lower limit of the Cr content is set to 12.00%, and preferably 12.50%, and more preferably 13.00%. On the other hand, if the Cr content is too high, the cold workability is deteriorated. Therefore, the upper limit of the Cr content is set to 18.00%, and preferably 17.50%, and more preferably 17.00%.

<3.500% or Less of Cu>

The Cu is an element that has a function of hardening the stainless steel during the heat treatment. However, if the Cu content is too high, the hot workability is deteriorated, which will cause cracking. Therefore, the upper limit of the Cu content is set to 3.500%, and preferably 3.000%, and more preferably 2.000%. On the other hand, the lower limit of the Cu content is not particularly limited, but it may preferably be set to 0.010%, and more preferably 0.020%, and even more preferably 0.030%.

<1.00 to 5.00% of Mo>

The Mo is an effective element for improving the corrosion resistance of the austenitic stainless steel material. The Mo is also an effective element for suppressing the release of strain generated during cold rolling. In view of the recent use in structural parts and functional parts (particularly plate springs) for which improvement in corrosion resistance and settling resistance is required, the lower limit of the Mo content is set to 1.00%, and preferably 1.30%, and more preferably 1.50%. On the other hand, since Mo is expensive, an excessively high Mo content will increase the production cost. Further, the δ-ferrite phase and the α-ferrite phase are generated at an elevated temperature. Therefore, the upper limit of the Mo content is set to 5.00%, and preferably 4.50%, and more preferably 4.00%.

<0.200% or Less of N>

The N is an austenite-forming element. Further, the N is an extremely effective element for hardening the austenite phase and the martensite phase. However, an excessively high N content will cause blow holes during casting. Therefore, the upper limit of the N content is set to 0.200%, and preferably 0.150%, and more preferably 0.100%. On the other hand, the lower limit of the N content is not particularly limited, but it may preferably be set to 0.001%, and preferably 0.010%.

<Total Amount of C and N of 0.100% or More>

The C and N are elements that provide the same hardening action. From the viewpoint of sufficiently exerting such a hardening action, the lower limit of the total amount of C and N is set to 0.100%, and preferably 0.120%, and more preferably 0.140%.

<0.100% or Less of Al>

The Al has a higher oxygen affinity than Si and Mn. If the Al content is too high, coarse oxide-based inclusions, which function as starting points of internal cracks, are prone to be formed in cold rolling. Therefore, the upper limit of the Al content is preferably set to 0.100%, and more preferably 0.080%, and still more preferably 0.050%, and still more preferably 0.030%. On the other hand, the lower limit of the Al content is not particularly limited. However, an excessively low Al content leads to an increase in production cost. Therefore, it may preferably be set to 0.0001%, and more preferably 0.0003%, and even more preferably 0.0005%.

<0.010% or Less of O>

If the O content is too high, coarse inclusions having a particle size of more than 5 μm tends to be formed. Therefore, the upper limit of the O content is preferably set to 0.010%, and preferably 0.008%. On the other hand, the lower limit of the O content is not particularly limited. However, if the O content is too low, it will be difficult to oxidize Mn, Si and the like, so that a ratio of $Al_2O_3$ in the inclusions will be increased. Therefore, the lower limit of the O content is preferably set to 0.001%, and more preferably 0.003%.

<0.0001 to 0.500% of V>

The V is an element having a function of enhancing aging hardening properties in the heating of the heat treatment carried out after cold rolling. From the viewpoint of sufficiently producing such a function, the lower limit of the V content is preferably set to 0.0001%, and more preferably 0.001%. On the other hand, an excessively high V content leads to an increase in production cost. Therefore, the upper limit of the V content is preferably set to 0.500%, and more preferably 0.400%, and even more preferably 0.300%.

<0.0001 to 0.015% of B>

An excessively high B content causes a decrease in workability due to the generation of boride. Therefore, the upper limit of the B content is preferably set to 0.015%, and more preferably 0.010%. On the other hand, the lower limit of the B content is not particularly limited, but it may preferably be set to 0.0001%, and more preferably 0.0002%.

<0.010 to 0.500% of Ti>

The Ti is a carbonitride-forming element, and fixes C and N, and suppresses deterioration of corrosion resistance due to sensitization. From the viewpoint of exerting such an effect, the lower limit of the Ti content is preferably set to 0.010%, and more preferably 0.011%. On the other hand, if the Ti content is too high, an amount of solid solution of C and N will decrease, and it may be heterogeneously localized and precipitated as a carbide, which may inhibit the growth of recrystallized grains. Moreover, since Ti is expensive, the production cost will increase. Therefore, the upper limit of the Ti content is preferably set to 0.500%, and more preferably 0.400%, and even more preferably 0.300%.

<0.010 to 0.500% of Co>

The Co is an element that improves crevice corrosion resistance. From the viewpoint of exerting such an effect, the lower limit of the Co content is preferably set to 0.010%, and more preferably 0.020%. On the other hand, if the Co content is too high, the austenitic stainless steel material becomes hard to deteriorate the ductility. Therefore, the upper limit of the Co content is preferably set to 0.500%, and more preferably 0.100%.

<0.010 to 0.100% of Zr>

The Zr is an element having a high affinity to C and N, and has effects of precipitating as a carbide or a nitride during hot rolling, and of reducing solid solution C and solid solution N in the matrix phase to improve the workability. From the viewpoint of exerting such effects, the lower limit of the Zr content is preferably set to 0.010%, and more preferably 0.020%. On the other hand, if the Zr content is too high, the austenitic stainless steel material becomes hard to deteriorate the ductility. Therefore, the upper limit of the Zr content is preferably set to 0.100%, and more preferably 0.050%.

<0.010 to 0.100% of Nb>

The Nb is an element having a high affinity to C and N, and has effects of precipitating as a carbide or a nitride during hot rolling, and of reducing solid solution C and solid solution N in the matrix phase to improve the workability. From the viewpoint of exerting such effects, the lower limit of the Nb content is preferably set to 0.010%, and more preferably 0.020%. On the other hand, if the Nb content is too high, the austenitic stainless steel material becomes hard to deteriorate the ductility. Therefore, the upper limit of the Nb content is preferably set to 0.100%, and more preferably 0.050%.

<0.0005 to 0.0030% of Mg>

The Mg forms Mg oxide together with Al in a molten steel and acts as a deoxidizing agent. From the viewpoint of exerting such an action, the lower limit of the Mg content is preferably set to 0.0005%, and more preferably 0.0008%. On the other hand, if the Mg content is too high, the toughness of the austenitic stainless steel material will decrease. Therefore, the upper limit of the Mg content is preferably set to 0.0030%, and more preferably 0.0020%.

<0.0003 to 0.0030% of Ca>

The Ca is an element that improves hot workability. From the viewpoint of exerting such an effect of Ca, the lower limit of the Ca content is preferably set to 0.0003%, and more preferably 0.0005%. On the other hand, if the Ca content is too high, the toughness of the austenitic stainless steel material will decrease. Therefore, the upper limit of the Ca content is preferably set to 0.0030%, and more preferably 0.0020%.

<0.010 to 0.200% of Y>

The Y is an element that reduces viscosity of a molten steel and improves cleanliness. From the viewpoint of exerting such effects of Y, the lower limit of the Y content is preferably set to 0.010%, and more preferably 0.020%. On the other hand, if the Y content is too high, the effect of Y is saturated and the workability is deteriorated. Therefore, the upper limit of the Y content is preferably set to 0.200%, and more preferably 0.100%.

<0.001 to 0.100% of Ln>

The Ln (lanthanoids: elements having an atomic number of 57 to 71 such as La, Ce, Nd) is an element that improves oxidation resistance at an elevated temperature. From the viewpoint of exerting such an effect of Ln, the lower limit of the Ln content is preferably set to 0.001%, and more preferably 0.002%. On the other hand, if the Ln content is too high, the effect of Ln is saturated, surface defects are generated during hot rolling, so that the producibility is deteriorated. Therefore, the upper limit of the Ln content is preferably set to 0.100%, and more preferably 0.050%.

<0.001 to 0.500% of Sn>

The Sn is an element effective to improve the workability by promoting the formation of a deformed zone during rolling. From the viewpoint of exerting such an effect of Sn, the lower limit of the Sn content is preferably set to 0.001%, and more preferably 0.003%. On the other hand, if the Sn content is too high, the effect of Sn is saturated and the workability is deteriorated. Therefore, the upper limit of the Sn content is preferably set to 0.500%, and more preferably 0.200%.

<0.001 to 0.500% of Sb>

The Sb is an element that is effective to improve the workability by promoting the formation of a deformed zone during rolling. From the viewpoint of exerting such an effect of Sb, the lower limit of the Sb content is preferably set to 0.001%, and more preferably 0.003%. On the other hand, if the Sb content is too high, the effect of Sb is saturated and the workability is deteriorated. Therefore, the upper limit of the Sb content is preferably set to 0.500%, and more preferably 0.200%.

<0.010 to 0.100% of Pb>

The Pb is an element effective to improve free-cutting properties. From the viewpoint of exerting such an effect of Pb, the lower limit of the Pb content is preferably set to 0.010%, and more preferably 0.020%. On the other hand, an excessively high Pb content will decrease a melting point of grain boundaries and lowers the bonding force of the grain boundaries, so that there is a concern that the hot workability may be deteriorated such as liquefaction cracking due to the melting of the grain boundaries. Therefore, the upper limit of the Pb content is preferably set to 0.100%, and more preferably 0.090%.

<0.010 to 0.500% of W>

The W has an action of improving the strength at an elevated temperature without impairing the ductility at room temperature. From the viewpoint of exerting such an effect of W, the lower limit of the W content is preferably set to 0.010%, and more preferably 0.020%. On the other hand, if the W content is too high, coarse eutectic carbides are formed, causing a decrease in ductility. Therefore, the upper limit of the W content is preferably set to 0.500%, and more preferably 0.450%.

<$Md_{30}$: −40.0 to 0° C.>

The $Md_{30}$ represents a temperature (° C.) at which 50% of the structure is transformed into martensite when a strain of 0.30 is applied to the austenite (γ) monophase. Therefore, it means that as the Md30 is higher (higher temperature), the austenite is more unstable.

The $Md_{30}$ is represented by the following equation (1):

$$Md_{30}=551-462(C+N)-9.2Si-8.1Mn-29(Ni+Cu)-13.7Cr-18.5Mo \quad (1)$$

In the equation, the symbols of the elements each represents a content (% by mass) of each element.

If the $Md_{30}$ is too low, the stability of the austenite phase will increase, and it will be difficult to transform the austenite phase into the strain-induced martensite phase by cold rolling, so that the strength cannot be sufficiently increased. Therefore, the lower limit of the $Md_{30}$ is set to −40.0° C., and preferably −39.0° C., and more preferably −38.0° C. On the other hand, if the $Md_{30}$ is too high, the austenite phase becomes unstable and an amount of the strain-induced martensite phase transformed by cold rolling increases, resulting in a decrease in ductility. Therefore, the upper limit of the $Md_{30}$ is set to 0° C., and preferably −3.0° C., and more preferably −5.0° C.

The austenitic stainless steel material according to an embodiment of the present invention has a metallographic structure containing a strain-induced martensite phase.

If the amount of the strain-induced martensite phase is too low, the strength of the austenitic stainless steel material will decrease. Therefore, the lower limit of the content of the strain-induced martensite phase is set to 25% by volume, and preferably 26% by volume. On the other hand, if the amount of the strain-induced martensite phase is too high, properties such as the ductility of the austenitic stainless steel material will deteriorate. Therefore, the upper limit of the content of the strain-induced martensite phase is set to 35% by volume, and preferably 34% by volume.

Here, the content of the strain-induced martensite phase can be measured by using a method known in the art. For example, it may be measured using a ferrite scope or the like.

The austenitic stainless steel material according to the embodiment of the present invention has a tensile strength (TS) of 1450 MPa or more, and preferably 1460 MPa or more, and more preferably 1470 MPa or more. By controlling the tensile strength to such a range, the strength of the austenitic stainless steel material can be ensured. The upper limit of the tensile strength is not particularly limited, but it may typically be 2500 MPa, and preferably 2300 MPa, and more preferably 2000 MPa.

Here, the tensile strength of the austenitic stainless steel material can be measured in accordance with JIS Z 2241:2011.

The austenitic stainless steel material according to an embodiment of the present invention has an elongation at brake (EL) of 12.0% or more, and preferably 13.0% or more, and more preferably 14.0% or more. By controlling the elongation at break to such a range, the ductility of the austenitic stainless steel material can be ensured. The upper limit of the elongation at break is not particularly limited, but it may typically be 50.0%, and preferably 40.0%, and more preferably 30.0%.

Here, the elongation at break of the austenitic stainless steel material can be measured in accordance with JIS Z 2241:2011.

The austenitic stainless steel material according to an embodiment of the present invention has a tensile strength (TS)×an elongation at break (EL) of 24000 or more, and preferably 24100 or more, and more preferably 24200 or more. By controlling TS×EL to such a range, it is possible to ensure a balance between the strength and the ductility of the austenitic stainless steel material. The upper limit of TS×EL is not particularly limited, but it may typically be 50,000, and preferably 45,000, and more preferably 40,000.

The austenitic stainless steel material according to an embodiment of the present invention has a Vickers hardness of preferably 350 HV or more, and more preferably 400 HV or more. By controlling the Vickers hardness to such a range, the strength of the austenitic stainless steel material can be ensured. The upper limit of the Vickers hardness is not particularly limited, but it may typically be 650 HV, and preferably 600 HV.

The austenitic stainless steel material according to an embodiment of the present invention has a stress relaxation percentage of 1.20% or less, and preferably 1.19% or less, and more preferably 1.18% or less, which is represented by the following equation (2):

$$\text{Stress relaxation percentage}=(\sigma 1-\sigma 2)/\sigma 1 \quad (2)$$

In the equation, σ1 is a stress less than 0.2% yield strength, and 02 is a stress on 200 seconds after the stress of σ1 is applied.

By controlling the stress relaxation percentage to the above range, the settling resistance of the austenitic stainless steel can be ensured. The lower limit of the stress relaxation percentage is not particularly limited, but it may typically be 0%, and preferably 0.10%, and more preferably 0.20%.

Here, the 0.2% yield strength of the austenitic stainless steel material can be measured in accordance with JIS Z 2241:2011.

The thickness of the austenitic stainless steel material according to an embodiment of the present invention is not particularly limited, but it may preferably be 0.20 mm or less, and more preferably 0.15 mm or less, and still more preferably 0.10 mm or less. The controlling of the thickness to such a thickness can reduce the thicknesses and weights of various parts. The lower limit of the thickness may be adjusted depending on intended use and is not particularly limited, but it may typically be 0.01 mm or more.

The austenitic stainless steel material according to an embodiment of the present invention can be produced by subjecting a rolled material having the above composition to a solution heat treatment, followed by cold rolling and then a heat treatment.

The rolled material is not particularly limited as long as it has the above composition, and rolled materials produced by a method known in the art may be used. As the rolled material, a hot-rolled material or a cold-rolled material can be used, but the cold-rolled material having a lower thickness is preferable.

The hot-rolled material can be produced by melting the stainless steel having the above composition, forging or casting it, and then hot-rolling it. Further, the cold-rolled material can be produced by cold-rolling the hot rolled material. After each rolling, annealing or washing with an acid may optionally be carried out.

The conditions for the solution heat treatment (solid solution treatment) of the rolled material are not particularly limited and they may be appropriately set depending on the composition of the rolled material. For example, the rolled material can be subjected to a solution heat treatment by heating and maintaining the rolled material at 1000 to 1200° C., and then rapidly cooling it.

The cold rolling after the solution heat treatment is carried out at a rolling ratio sufficient to generate 25 to 35% by volume of strain-induced martensite phase. By carrying out the cold rolling, processing strain can be generated in the rolled material to transform a part of the austenite phase into the strain-induced martensite phase. Further, by carrying out the cold rolling at the above rolling ratio, an austenitic stainless steel material having a good balance between strength and ductility can be obtained.

The heat treatment after the cold rolling is carried out for the purpose of allowing for diffusion and solid solution of C and N in the austenite phase, which will cause solid solution in the strain-induced martensite phase.

The crystal structure of the strain-induced martensite phase is a body-centered cubic structure, whereas the crystal structure of the austenite phase is a face-centered cubic structure. The face-centered cubic structure has a higher solid solution limit of C and N than that of the body-centered cubic structure. Since the strain-induced martensite phase is a phase formed by transformation from a structure that has been an austenite phase by cold rolling, C and N will be in a state of supersaturated solid solution even though it has the body-centered cubic structure. In such a state, the ductility of the austenitic stainless steel material is not sufficiently improved.

Therefore, the heat treatment after the cold rolling is carried out, thereby bringing about diffusion and solid solution of the C and N in the austenite phase having the higher solid solution limit, which would otherwise be in supersaturated solid solution in the strain-induced martensite phase. Since C and N are austenite-stabilizing elements, the degree of stabilization of the austenite phase is increased by diffusion and solid solution in the austenite phase, so that a TRIP (transformation-induced plasticity) effect can be promoted to achieve both high strength and high ductility.

Further, the heat treatment after the cold rolling also contributes to improvement of settling resistance. The settling is caused by the strain introduced into the rolled material by the cold rolling or the like, but the strain is reduced by carrying out the heat treatment after the cold rolling, so that the settling resistance can be improved.

To obtain the above effects, the heat treatment after the cold rolling is carried out under conditions that a temperature is 100 to 200° C. and a value of P represented by the following equation (3) satisfies 7000 to 9400. The temperature is preferably 110 to 190° C., and more preferably 120 to 180° C. The value of P is preferably 7200 to 9300, and more preferably 7400 to 9000.

$$P=T(\log t+20) \quad (3)$$

In the equation, T is temperature (K) and t is time (h).

By carrying out the heat treatment under the above conditions, the settling resistance can be improved while achieving both high strength and high ductility. If the heat treatment temperature is more than 200° C. and the value of P is more than 9400, precipitates are formed in the strain-induced martensite in the heat treatment, so that the strength can be increased, but the ductility is significantly decreased. Further, if the heat treatment temperature is less than 100° C. and the value of P is less than 7000, they cannot bring about sufficient diffusion and solid solution C and N in the austenite phase, which would otherwise lead to supersaturated solid solution in the strain-induced martensite phase.

The austenitic stainless steel material according to an embodiment of the present invention has high strength and high ductility, and has improved settling resistance. Therefore, it can be used for various parts that are required to reduce the thickness and weight, for example, structural parts and functional parts in communication devices such as smartphones and precision devices such as personal computers. In particular, the austenitic stainless steel material according to the embodiment of the present invention is suitable for use in plate springs.

Examples

Hereinafter, the present invention will be described in detail with reference to Examples. However, it should not be construed that the present invention is limited to those Examples.

Thirty Kilograms of stainless steel having each composition as shown in Table 1 were melted by vacuum melting, forged into a plate having a thickness of 30 mm, and then heated at 1230° C. for 2 hours, and hot-rolled to a thickness of 4 mm to obtain a hot-rolled plate. The hot-rolled plate was then annealed and washed with an acid to obtain a hot-rolled annealed plate, and the hot-rolled annealed plate was then subjected to repeated cold-rolling and annealing to decrease the thickness, and cold-rolled to have a final thickness of 0.2 to 1 mm to obtain a cold-rolled plate.

TABLE 1

| Steel | Composition (% by mass) | | | | | | | | | | | | | $Md_{30}$ |
|---|---|---|---|---|---|---|---|---|---|---|---|---|---|---|
| Type | C | Si | Mn | Ni | Cr | Cu | Mo | N | C + N | Al | V | B | Ti | (° C.) |
| A | 0.086 | 2.63 | 0.31 | 8.25 | 13.73 | 0.170 | 2.24 | 0.064 | 0.150 | — | — | — | — | −18.7 |
| B | 0.089 | 2.54 | 1.20 | 7.78 | 14.32 | 0.203 | 1.89 | 0.054 | 0.143 | — | — | — | — | −10.8 |
| C | 0.087 | 2.56 | 0.30 | 8.78 | 13.89 | 0.160 | 2.18 | 0.068 | 0.155 | — | — | — | — | −36.5 |
| D | 0.082 | 2.44 | 0.27 | 8.14 | 13.57 | 0.140 | 2.35 | 0.070 | 0.152 | — | 0.002 | — | 0.093 | −13.4 |
| E | 0.071 | 2.23 | 0.29 | 7.65 | 13.78 | 2.100 | 1.67 | 0.061 | 0.132 | 0.080 | — | — | — | −35.3 |
| F | 0.085 | 2.34 | 0.33 | 8.67 | 14.22 | 0.151 | 2.02 | 0.071 | 0.156 | — | — | 0.011 | — | −33.3 |
| a | 0.100 | 0.67 | 1.08 | 6.80 | 16.88 | 0.250 | 0.15 | 0.046 | 0.146 | 0.001 | — | — | — | 30.2 |
| b | 0.086 | 2.55 | 0.29 | 8.97 | 14.56 | 0.180 | 2.38 | 0.071 | 0.157 | 0.001 | — | — | — | −56.2 |

(Remarks) The underlines indicate that they are beyond the scope of the present invention. The balance is Fe and impurities.

Subsequently, the cold-rolled material obtained above was subjected to a solution hot treatment which was maintained at 1050° C. for 10 minutes and then rapidly cooled. The cold rolling was then carried out at each rolling ratio as shown in Table 2, and the heat treatment was then carried out under the conditions as shown in Table 2 to obtain an austenitic stainless steel material. In addition, the test Nos. 2 and 5 were subjected to cold-roll finishing without the heat treatment.

The austenitic stainless steel material thus obtained was evaluated as follows.

(Amount of Strain-Induced Martensite Phase)

A sample was cut out from each of austenitic stainless steel materials, and an amount of strain-induced martensite was measured using a ferrite scope (FERITESCOPE MP30E-S from Fisher). The measurement was carried out at arbitrary three points on the surface of the sample, and an average value thereof was used as the results. In Table 2, the amount of the strain-induced martensite phase is referred to as "Amount of M Phase".

(0.2% Yield Strength, Tensile Strength (TS) and Elongation at Break (EL))

A JIS 13 B sample was cut out from each of the austenitic stainless steel materials, and the measurement was carried out using this sample in accordance with JIS Z 2241:2011.

(Vickers Hardness)

A sample was cut out from each of the austenitic stainless steel materials, and the Vickers hardness was determined in accordance with JIS Z 2244:2009 using a Vickers hardness tester. The test force was 294.2N. The Vickers hardness was determined at arbitrary five points, and an average value thereof was used as the results. In Table 2, the Vickers hardness is abbreviated as "Hardness".

(Stress Relaxation Percentage)

The stress relaxation percentage was determined based on the above equation (2). The σ1 was 300 MPa. The tensile speed until σ1 reached 300 MPa was 0.5 mm/sec.

The results of each of the above evaluations are shown in Table 2.

TABLE 2

| Test Nos. | Type of Steel | Cold Rolling Ratio (%) | Thickness (mm) | Heat Treatment Temp. (° C.) | Heat Treatment Time (s) | Heat Treatment P Value | Amount of M Phase (vol. %) | 0.2% Yield Strength (MPa) | TS (MPa) | EL (%) | Hardness (HV) | TS × EL | Stress Relaxation Percentage (%) | Group |
|---|---|---|---|---|---|---|---|---|---|---|---|---|---|---|
| 1 | A | 20 | 0.10 | 150 | 3600 | 8460 | 18 | 1067 | 1401 | 36.6 | 401 | 51277 | 1.12 | Comp. |
| 2 | A | 20 | 0.10 | - | - | - | 18 | 973 | 1369 | 34.8 | 397 | 47641 | 2.60 | Comp. |
| 3 | A | 25 | 0.09 | 150 | 3600 | 8460 | 27 | 1352 | 1566 | 21.1 | 443 | 33108 | 1.15 | Ex. |
| 4 | A | 30 | 0.08 | 150 | 3600 | 8460 | 32 | 1505 | 1548 | 17.5 | 507 | 27090 | 0.98 | Ex. |
| 5 | A | 30 | 0.08 | - | - | - | 32 | 1411 | 1516 | 15.7 | 503 | 23801 | 1.67 | Comp. |
| 6 | A | 40 | 0.07 | 150 | 3600 | 8460 | 39 | 1721 | 1739 | 8.2 | 498 | 14260 | 1.02 | Comp. |
| 7 | A | 60 | 0.05 | 150 | 3600 | 8460 | 49 | 2074 | 2046 | 4.1 | 551 | 8389 | 0.88 | Comp. |
| 8 | B | 20 | 0.16 | 150 | 3600 | 8460 | 26 | 1313 | 1565 | 22.5 | 438 | 35213 | 1.13 | Ex. |
| 9 | C | 45 | 0.11 | 150 | 3600 | 8460 | 33 | 1544 | 1673 | 14.5 | 476 | 24259 | 1.04 | Ex. |
| 10 | D | 30 | 0.14 | 150 | 3600 | 8460 | 29 | 1402 | 1611 | 17.8 | 449 | 28676 | 1.06 | Ex. |
| 11 | E | 45 | 0.11 | 150 | 3600 | 8460 | 31 | 1531 | 1632 | 14.8 | 468 | 24154 | 1.03 | Ex. |
| 12 | F | 45 | 0.11 | 150 | 3600 | 8460 | 30 | 1520 | 1627 | 15.1 | 462 | 24568 | 1.03 | Ex. |
| 13 | a | 40 | 0.18 | 150 | 3600 | 8460 | 37 | 1320 | 1550 | 15.0 | 490 | 23250 | 1.06 | Comp. |
| 14 | b | 50 | 0.15 | 150 | 3600 | 8460 | 13 | 1453 | 1534 | 3.6 | 451 | 5522 | 0.99 | Comp. |
| 15 | A | 30 | 0.70 | 100 | 3600 | 7460 | 32 | 1435 | 1482 | 23.3 | 501 | 34468 | 1.18 | Ex. |
| 16 | A | 30 | 0.70 | 200 | 3600 | 9460 | 32 | 1585 | 1605 | 9.9 | 515 | 15890 | 1.12 | Comp. |
| 17 | A | 30 | 0.70 | 300 | 3600 | 11460 | 32 | 1638 | 1681 | 7.0 | 526 | 11767 | 1.04 | Comp. |
| 18 | A | 30 | 0.70 | 400 | 3600 | 13460 | 32 | 1658 | 1715 | 6.8 | 540 | 11662 | 0.97 | Comp. |

(Remarks) The underlines indicate that they are beyond the scope of the present invention.

As shown in Table 2, it was confirmed that the austenitic stainless steel materials of Test Nos. 3 to 4, 8 to 12 and 15 (Examples of the present invention) had good results of all the tensile strength (TS), elongation at break (EL), TS×EL and stress relaxation percentage, and had high strength and high ductility, and improved settling resistance.

On the other hand, the austenitic stainless steel materials of Test Nos. 1 and 2 (Comparative Examples) had insufficient tensile strength (TS) because the amount of the strain-induced martensite phase was too low. Further, the austenitic stainless steel material of Test No. 2 also had a higher stress relaxation percentage because it was not subjected to the heat treatment after the cold rolling.

The austenitic stainless steel material of Test No. 5 (Comparative Example) had a lower TS×EL because it was not subjected to the heat treatment after the cold rolling.

The austenitic stainless steel materials of Test Nos. 6 and 7 (Comparative Examples) had an excessively high amount of the strain-induced martensite phase, so that the elongation at break (EL) was deteriorated and the TS×EL was also deteriorated.

The austenitic stainless steel materials of Test Nos. 13 and 14 (Comparative Examples) did not have an appropriate composition, and the amount of the strain-induced martensite phase was also beyond the defined range, so that the elongation at break (EL) and TS×EL were deteriorated.

The austenitic stainless steel materials of Test Nos. 16 to 18 (Comparative Examples) had excessively high P value and temperature of the heat treatment, so that the elongation at break (EL) and TS×EL were deteriorated.

As can be seen from the above results, according to the present invention, it is possible to provide an austenitic stainless steel material having high strength, high ductility, and improved settling resistance, and to provide a method for producing the same.

Also, according to the present invention, it is possible to provide a plate spring having high strength, excellent dimensional accuracy, and a long life.

The invention claimed is:

1. An austenitic stainless steel plate, wherein the austenitic stainless steel plate comprises, on a mass basis, 0.200% or less of C, 1.00 to 3.50% of Si, 5.00% or less of Mn, 4.00 to 10.00% of Ni, 12.00 to 18.00% of Cr, 3.500% or less of Cu, 2.18 to 5.00% of Mo, and 0.200% or less of N, a total amount of C and N is 0.100% or more, and the balance is Fe and impurities;

wherein the austenitic stainless steel plate has a composition having a value of $Md_{30}$ of −40.0 to 0° C., wherein the value of $Md_{30}$ is represented by the following equation (1):

$$Md_{30}=551-462(C+N)-9.2Si-8.1Mn-29(Ni+Cu)-13.7Cr-18.5Mo \quad (1)$$

in which the symbols of the elements each represents a content (% by mass) of each element;

wherein the austenitic stainless steel plate has a metallographic structure comprising 25 to 35% by volume of strain-induced martensite phase;

wherein the austenitic stainless steel plate has a tensile strength (TS) of 1450 MPa or more, an elongation at break (EL) of 12.0% or more, TS×EL of 24000 or more, and a stress relaxation percentage of 1.20% or less, wherein the stress relaxation percentage is represented by the following equation (2):

$$\text{stress relaxation percentage}=(\sigma1-\sigma2)/\sigma1 \quad (2)$$

in which σ1 is a stress less than 0.2% yield strength, and σ2 is a stress on 200 seconds after applying the stress of σ1, and wherein the austenitic stainless steel plate has a thickness of 1 mm or less.

2. The austenitic stainless steel plate according to claim 1, further comprising, on a mass basis, one or more selected from 0.100% or less of Al, 0.010% or less of O, 0.0001 to 0.500% of V, and 0.0001 to 0.015% of B.

3. The austenitic stainless steel plate according to claim 1, further comprising, on a mass basis, one or more selected from 0.010 to 0.500% of Ti, 0.010 to 0.500% of Co, 0.010 to 0.100% of Zr, 0.010 to 0.100% of Nb, 0.0005 to 0.0030% of Mg, 0.0003 to 0.0030% of Ca, 0.010 to 0.200% of Y, 0.001 to 0.100% of lanthanoids, 0.001 to 0.500% of Sn, 0.001 to 0.500% of Sb, 0.010 to 0.100% of Pb, and 0.010 to 0.500% of W.

4. The austenitic stainless steel plate according to claim 1, wherein the austenitic stainless steel plate has a thickness of 0.20 mm or less.

5. The austenitic stainless steel plate according to claim 1, wherein the austenitic stainless steel plate is used for a plate spring.

6. The austenitic stainless steel plate according to claim 2, further comprising, on a mass basis, one or more selected from 0.010 to 0.500% of Ti, 0.010 to 0.500% of Co, 0.010 to 0.100% of Zr, 0.010 to 0.100% of Nb, 0.0005 to 0.0030% of Mg, 0.0003 to 0.0030% of Ca, 0.010 to 0.200% of Y, 0.001 to 0.100% of lanthanoids, 0.001 to 0.500% of Sn, 0.001 to 0.500% of Sb, 0.010 to 0.100% of Pb, and 0.010 to 0.500% of W.

7. The austenitic stainless steel plate according to claim 2, wherein the austenitic stainless steel plate has a thickness of 0.20 mm or less.

8. The austenitic stainless steel plate according to claim 3, wherein the austenitic stainless steel plate has a thickness of 0.20 mm or less.

9. The austenitic stainless steel plate according to claim 6, wherein the austenitic stainless steel plate has a thickness of 0.20 mm or less.

10. A plate spring, comprising the austenitic stainless steel plate according to claim 1.

11. A plate spring, comprising the austenitic stainless steel plate according to claim 2.

12. A plate spring, comprising the austenitic stainless steel plate according to claim 3.

13. A plate spring, comprising the austenitic stainless steel plate according to claim 6.

* * * * *